US006042186A

United States Patent [19]

Kojic et al.

[11] Patent Number: 6,042,186

[45] Date of Patent: Mar. 28, 2000

[54] INFLATABLE SEATING APPARATUS

[75] Inventors: Maria Kojic, N. Hollywood; Alison J. Ferber, Los Angeles, both of Calif.

[73] Assignee: $CO_{2UCH}$, Inc., Los Angeles, Calif.

[21] Appl. No.: 09/170,503

[22] Filed: Oct. 13, 1998

Related U.S. Application Data

[60] Provisional application No. 60/061,844, Oct. 14, 1997.

[51] Int. Cl.[7] ..... A47C 4/54

[52] U.S. Cl. ..... 297/452.41; 5/12.1; 5/59.1; 5/710; 5/722; 5/723

[58] Field of Search ..... 297/452.41, 250.1; 5/12.1, 28, 59.1, 706, 710, 222, 723

[56] References Cited

U.S. PATENT DOCUMENTS

| | | | |
|---|---|---|---|
| 1,976,320 | 10/1934 | Austin | 297/452.41 X |
| 2,623,574 | 12/1952 | Damsch | 297/452.41 X |
| 3,286,285 | 11/1966 | Harvey, Jr. | 297/452.41 X |
| 3,572,836 | 3/1971 | Khanh | 297/452.41 |
| 3,959,835 | 6/1976 | Nos | 5/368 |
| 4,836,605 | 6/1989 | Greenwood et al. | 297/250.1 |
| 4,905,332 | 3/1990 | Wang | 5/710 X |
| 5,267,363 | 12/1993 | Chaffee | 5/453 |
| 5,335,968 | 8/1994 | Sheridan et al. | 297/250.1 |
| 5,367,726 | 11/1994 | Chaffee | 5/449 |
| 5,560,056 | 10/1996 | Tai | 5/722 X |

OTHER PUBLICATIONS

Four (4) pages of catalog for air beds, pools, and beach boats by Aqua–Marine International, Inc., 4FL–3., No. 70, Sec. 2, Roosevelt Rd., Taipei, Taiwan (Rep. of China).

*Primary Examiner*—Peter R. Brown
*Attorney, Agent, or Firm*—Townsend and Townsend and Crew LLP

[57] ABSTRACT

The present invention provides exemplary inflatable seating apparatus, systems and methods of use. In one embodiment, an inflatable seating apparatus (10) includes a first inflatable mattress (12) and a second inflatable mattress (14) rotatably connected to the first mattress by a hinge (16). The hinge has at least one passageway (20) to permit the passage of an inflating fluid between the first and second mattresses. The inflatable seating apparatus further may include a third inflatable mattress (22), forming a back of the seating apparatus, that is removably attached to the first mattress.

24 Claims, 8 Drawing Sheets

Fig. 2A
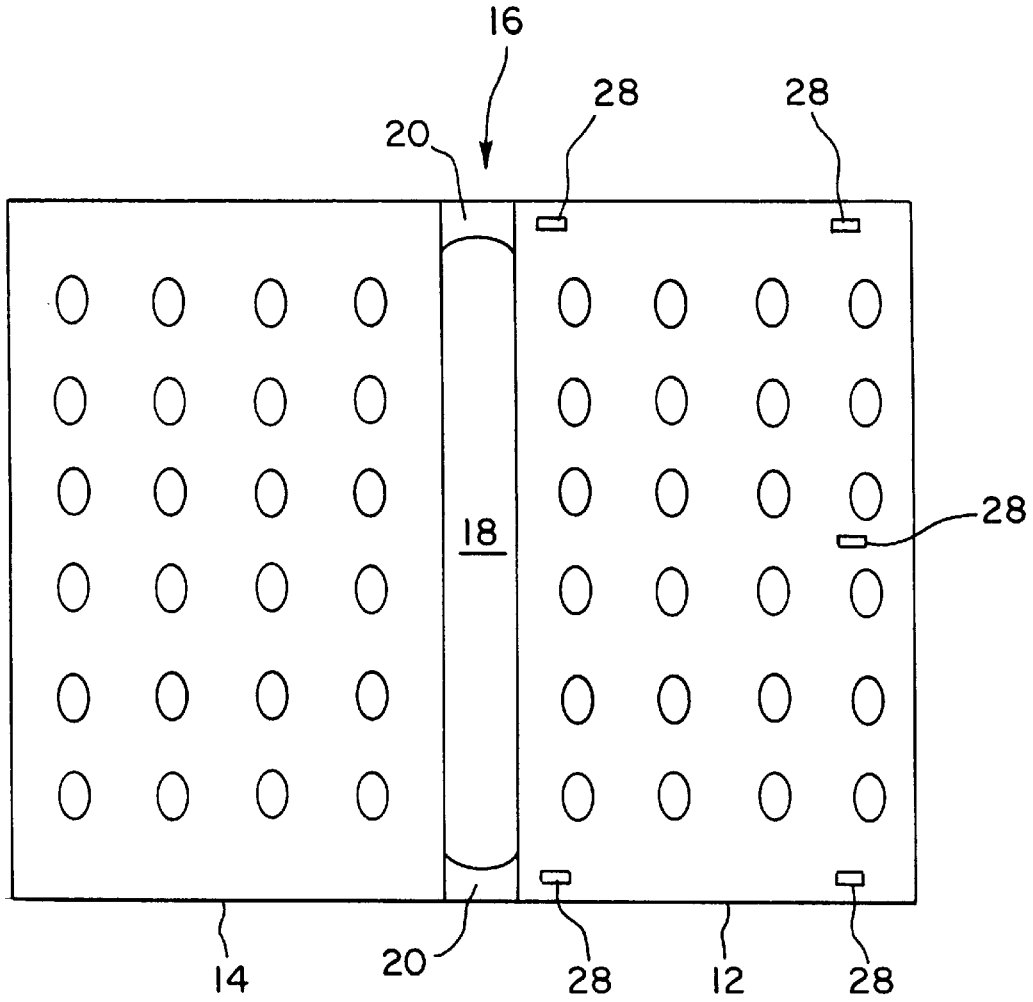
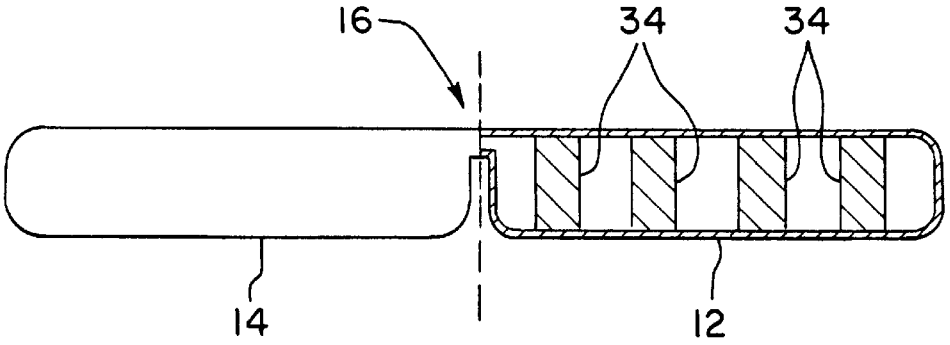
Fig. 2B

Fig. 3A
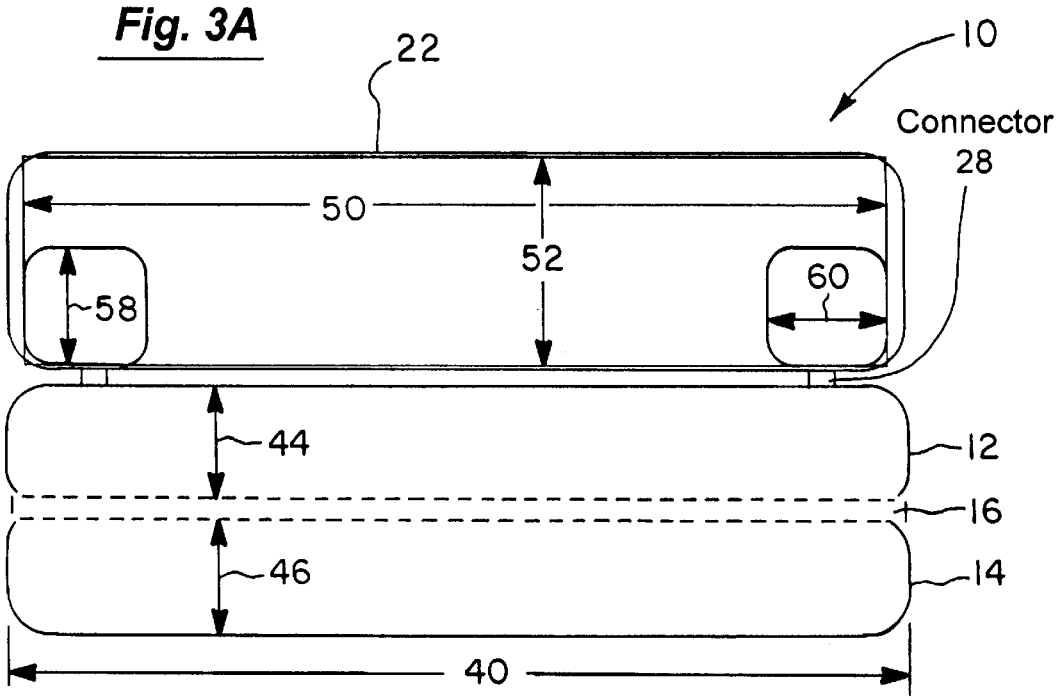
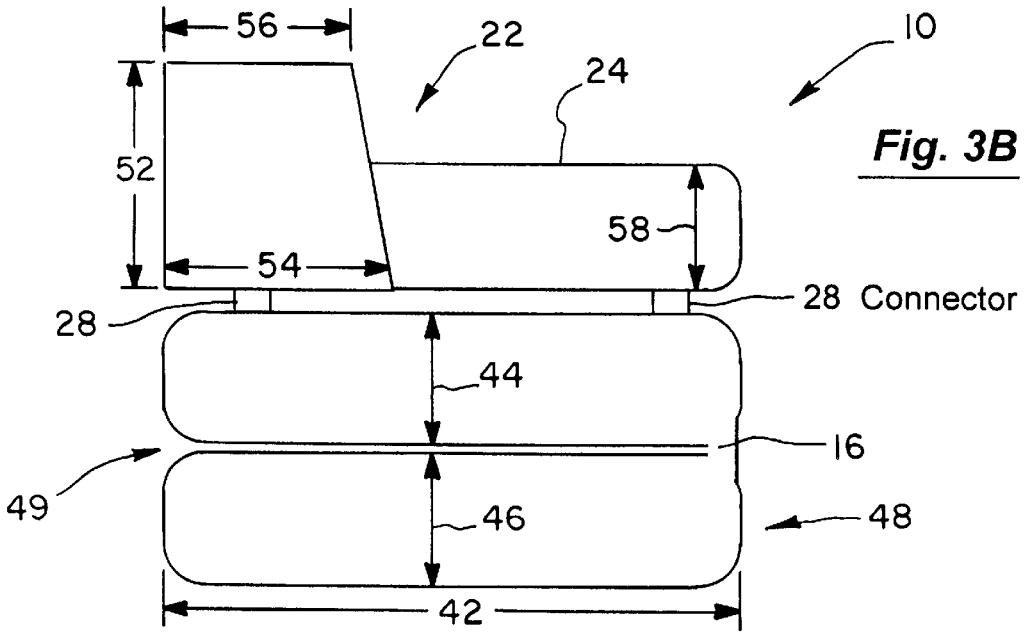
Fig. 3B

Fig. 5A
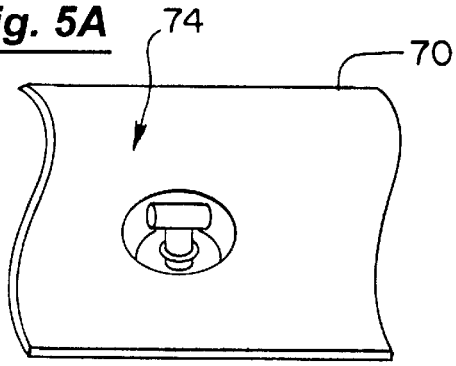
Fig. 5B
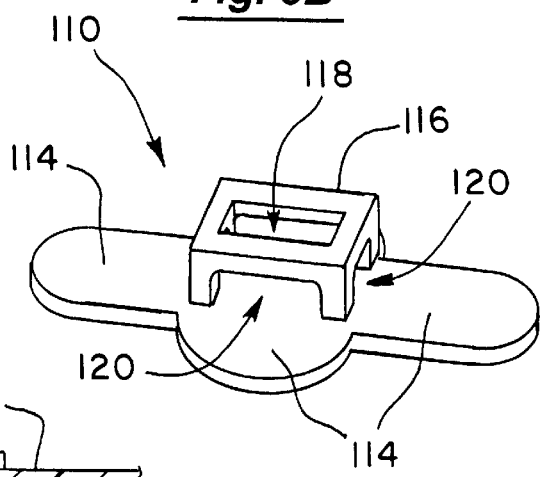
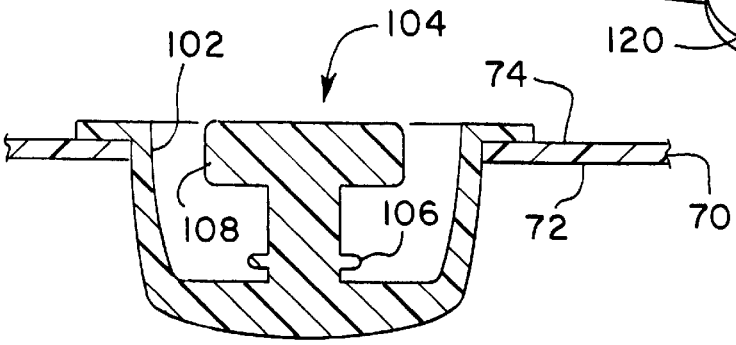
Fig. 5C
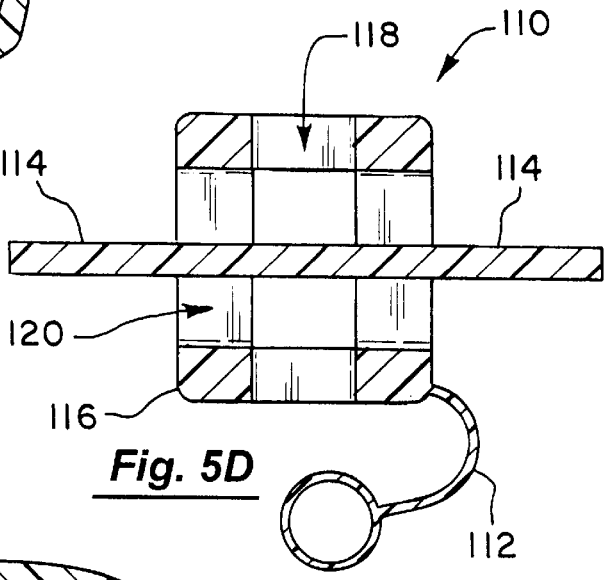
Fig. 5D
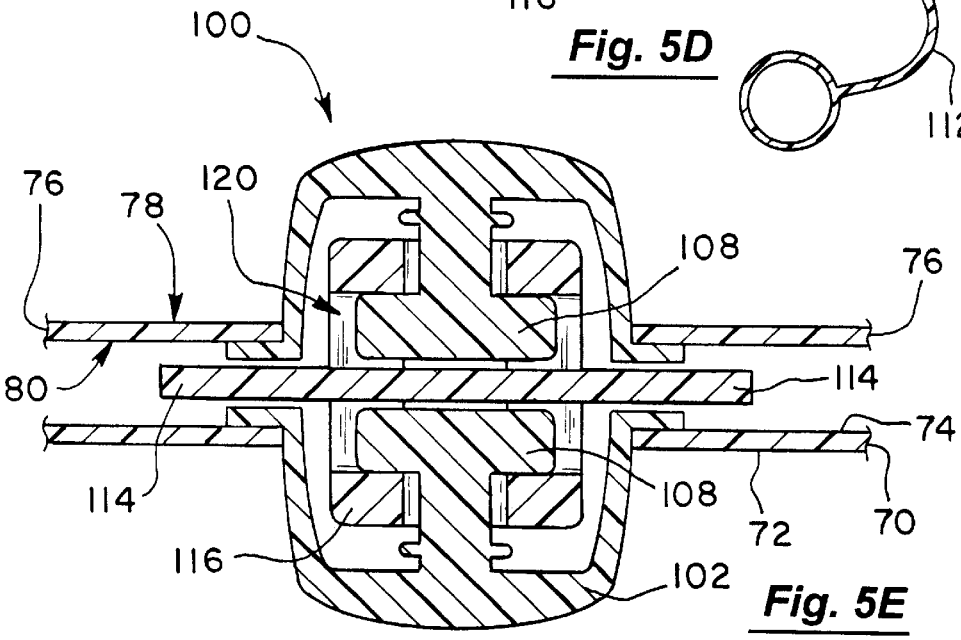
Fig. 5E Fig. 8
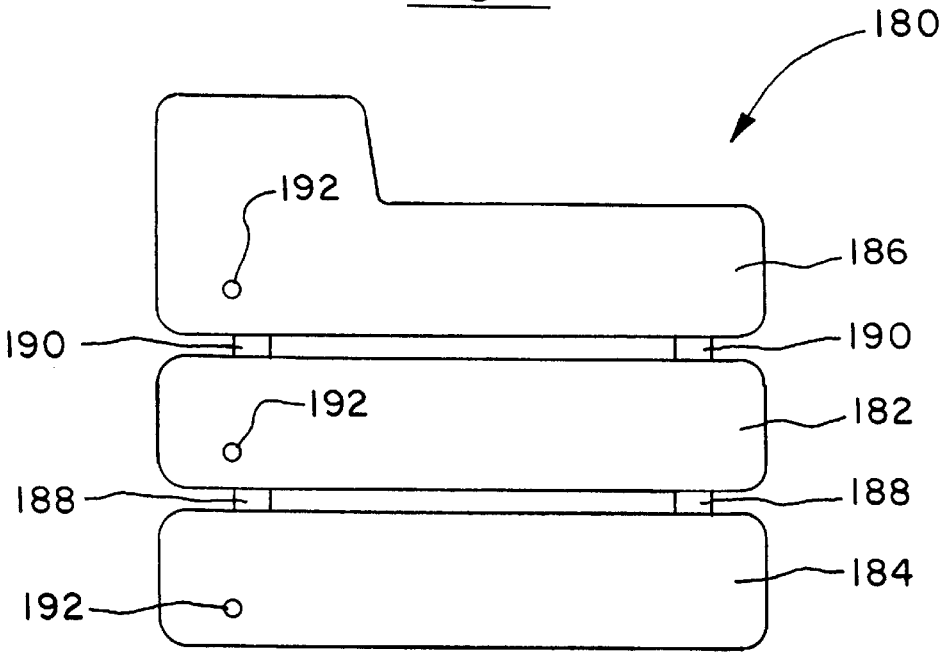
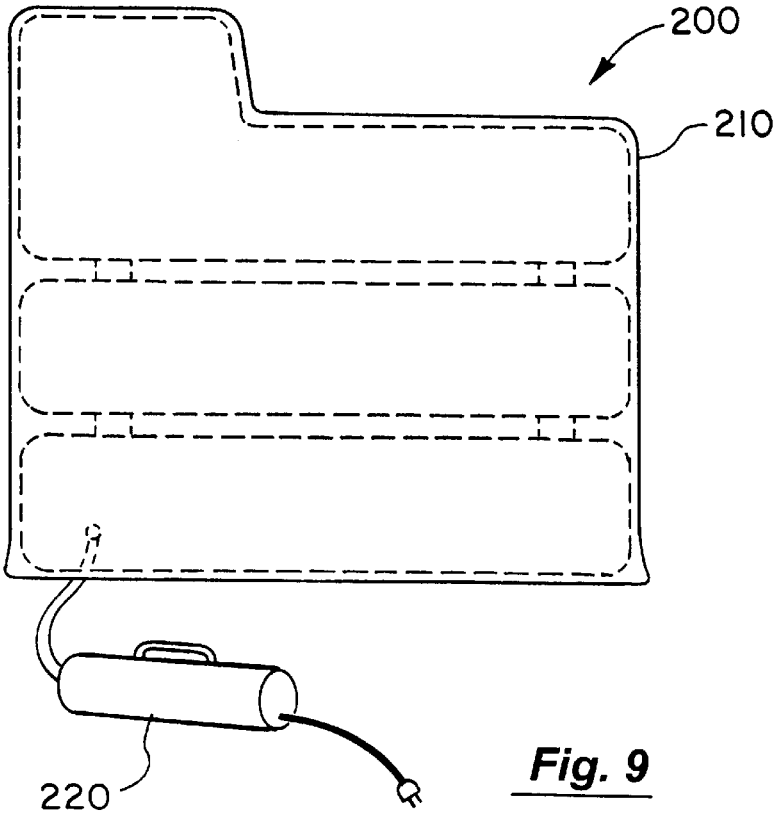
Fig. 9

INFLATABLE SEATING APPARATUS

This application claims the benefit of U.S. Provisional Application Ser. No. 60/061,844, filed Oct. 14, 1997, the complete disclosure of which is incorporated herein by reference.

BACKGROUND OF THE INVENTION

The present invention pertains to seating apparatus, and more specifically, to inflatable, portable and storable seating apparatus, systems and methods of use.

The use of an inflatable mattress for camping and the like is known. People have used inflatable mattresses underneath sleeping bags to provide comfort on camping trips. Inflatable flotation devices also are known, for example for use by sunbathers at pools and lakes. For a number of reasons, however, inflatable seating apparatus have not been as well received.

To date, inflatable mattresses and inflatable furniture have experienced several difficulties. For example, inflatable devices to date typically provide insufficient stability to support seated adults who are more accustomed to wood or upholstered furniture. Difficulties in inflation, concern over punctures, and a lack of aesthetic appeal also are reasons why inflatable seating devices have not found widespread use in the American home.

It is desirable, therefore, to provide inflatable seating apparatus which are easily inflated and deflated in addition to being portable, storable and durable. It is further desirable to provide inflatable seating apparatus that are aesthetically pleasing and sufficiently stable for adult users without undue sagging or other instabilities.

SUMMARY OF THE INVENTION

The present invention provides exemplary inflatable seating apparatus, systems and methods of use. Seating apparatus of the present invention are sufficiently stable to allow adult users to comfortably rest thereon without undue rotations, vibrations or other unstable movements. Seating apparatus of the present invention further are easily inflated, and are portable and storable. The seating apparatus is adaptable to operate as a bed or bed-like apparatus by having one or more mattresses capable of laying flat and operating as a sleeping surface.

In one embodiment of the present invention, an inflatable seating apparatus includes a first inflatable mattress and a second inflatable mattress rotatably connected to the first mattress by a hinge. The hinge has at least one passageway to permit the passage of an inflating fluid, preferably air, between the first and second mattresses. The inflatable seating apparatus further includes a third inflatable mattress forming a back of the seating apparatus. The third mattress is removably attached to the first mattress. In this manner, the seating portion of the apparatus comprises two mattresses hingedly connected together. The hinge passageway permits the transfer of the inflating fluid between the mattresses on which a user sits. The back portion of the seating apparatus comprises the third mattress attached to the uppermost seating mattress.

The inflatable seating apparatus preferably has a hinge which permits rotation of at least about 180°. In this manner, the first and second mattresses may be positioned in a stacked configuration or a side-by-side configuration. This permits the first and second mattress to be used as a bed-like surface or as a seating surface. In one aspect, a plurality of support strips are provided within the first and second mattresses. The support strips may include spaced apart cylindrical or loop-shaped strips, planar strips and the like. Such support strips provide support to the mattress during use. Support strips further provide a patterned surface caused by the imprint of the support strips when attached to the mattress surfaces.

In one aspect, the hinge includes a seam portion rotatably connecting the first and second mattress, preferably along the edge of the mattresses. In one aspect, the seam portion runs nearly the entire length of the mattresses, and the air passageways between the mattresses occupies only a portion of the hinge. In another aspect, the hinge is integrally formed with the first and second mattresses.

Preferably, the first and second mattresses comprise polyvinylchloride (PVC). The hinge also preferably comprises PVC. Other materials may be used within the scope of the present invention, including rubber, rubberized nylon, rubberized rayon, rubberized fabric, PVC-fused materials such as rayon or fabric, and the like.

In one aspect, the third mattress is connected to the first mattress with a plurality of connectors. The connectors may include T-bar connectors, recessed T-bar connectors, snaps, hook and loop fasteners, clips and the like.

In one aspect, recessed T-bar connectors are used to connect the third mattress to the first mattress. In another aspect, connectors instead of the hinge are used to connect the first and second mattresses. By using connectors between the first and second mattresses, one or both of the mattresses can be separated and used independently as, for example, a pool floatation device or bed-like apparatus.

The present invention further provides a seating system which includes an inflatable seating apparatus as previously described, an inflation device, and a removable slip cover to at least partially cover the seating apparatus. In this manner, providing the removable slip covers permits users to change the aesthetics of the seating apparatus to match the decor of the room in which the apparatus is used.

The present invention further provides methods of using an inflatable seating apparatus. In one exemplary method, an inflatable seating apparatus is provided in a deflated state. The seating apparatus includes first and second inflatable mattresses connected by a hinge. The hinge has at least one passageway to permit the passage of an inflating fluid between the mattresses. The method includes inflating the first and second mattresses in a single step, rotating the hinge to position the mattresses in a stacked arrangement and sitting on the stacked mattresses.

Other features and advantages of the invention will appear from the following description in which the preferred embodiment has been set forth in detail in conjunction with the accompanying drawings.

BRIEF DESCRIPTION OF THE DRAWINGS

FIG. 2A is a top view of the first and second mattresses of the seating apparatus shown in FIG. 1;

FIG. 2B is a partial side view and partial side cross-sectional view of the mattresses depicted in FIG. 2A;

FIGS. 3A–3B are front and side plan views, respectively, of the seating apparatus of FIG. 1;

FIGS. 5A–5E depict an exemplary connector for use with the present invention;

FIG. 8 depicts another embodiment of an inflatable seating apparatus of the present invention; and FIG. 9 depicts an inflatable seating system of the present invention, including a slip cover and inflation device.

DESCRIPTION OF THE PREFERRED EMBODIMENT

Figure 1:
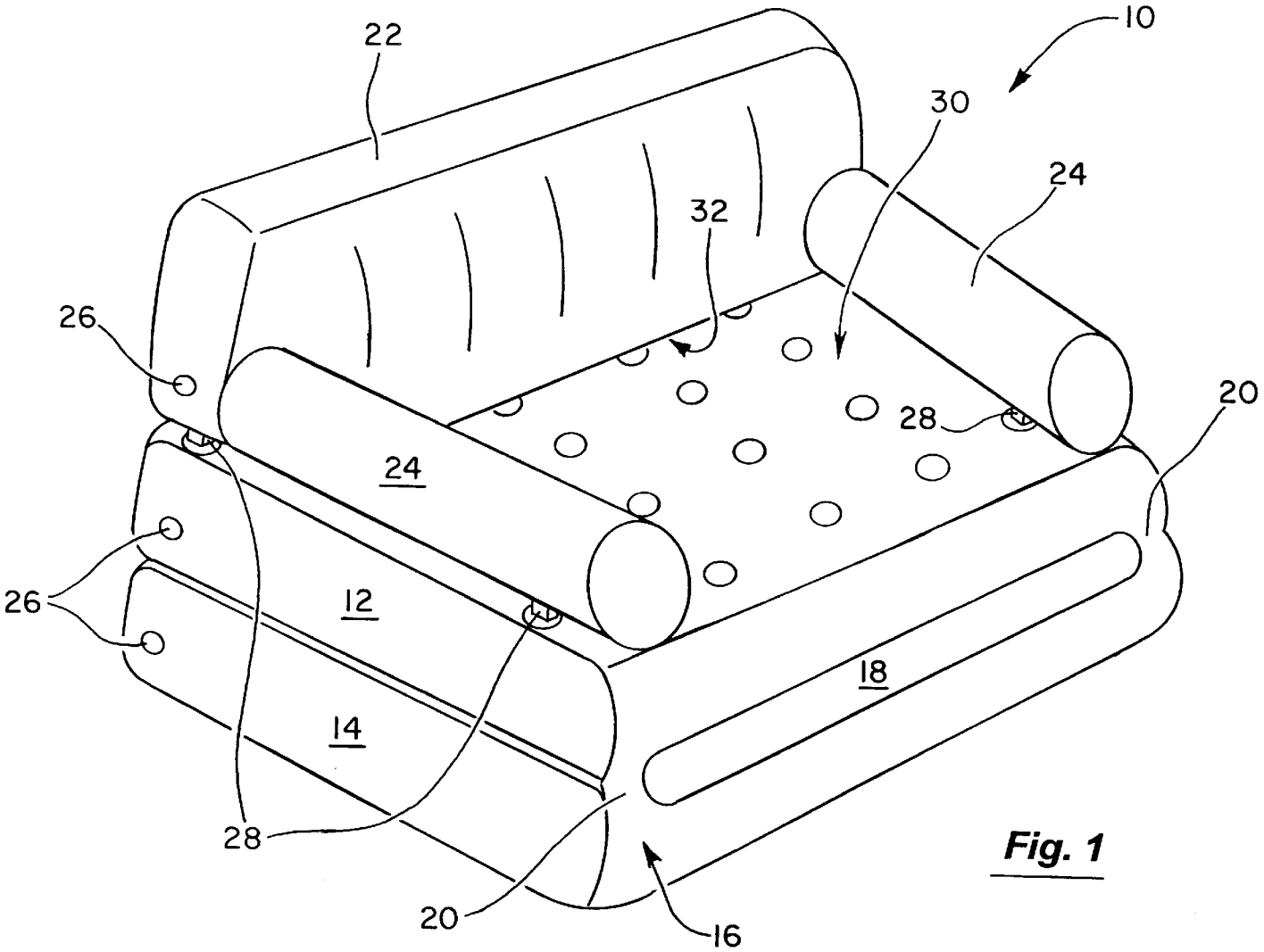
FIG. 1 is an overall view of an inflatable seating apparatus of the present invention.

FIG. 1 depicts an inflatable seating apparatus 10 according to the present invention. Seating apparatus 10 includes a first inflatable mattress 12 and a second inflatable mattress 14 hingedly connected by a hinge 16. Hinge 16 includes a seam portion 18 and at least one air passageway 20. As shown in FIG. 1, hinge 16 has two air passageways 20 separated by seam portion 18. The spacing and number of passageways 20 may vary within the scope of the present invention.

Seating apparatus 10 further includes a third inflatable mattress 22. Third mattress 22 preferably includes two armrests 24. It will be appreciated by those skilled in the art that third mattress 22 may have a different number of armrests 24, or no armrests 24, within the scope of the present invention. Third mattress 22 is connected to first mattress 12 by a plurality of connectors 28, as further described in conjunction with later figures. Seating apparatus 10 is inflated using a fluid port 26 for each inflatable chamber. Air is preferably used as the inflation fluid, but fluid ports 26 are adapted to receive a variety of inflation fluids, including other gases, water and the like. Due to passageways 20, first mattress 12 and second mattress 14 may be inflated in a single step. First mattress 12 and second mattress 14 both have at least one fluid port 26 to assist in the deflation of the device, however, only one fluid port 26 need be used to inflate both first and second mattresses 12, 14.

As shown in FIG. 1, connectors 28 connect an upper surface 30 of first mattress 12 with a lower surface 32 of third mattress 22. As depicted, third mattress 22 forms the back portion of seating apparatus 10. Preferably, first mattress 12, second mattress 14, third mattress 22, and hinge 16 all comprise polyvinylchloride (PVC). PVC provides a sufficiently resilient and light weight material to resist against puncture as well as providing for ease of storage and portability. Other materials also may be used for each of these elements within the scope of the present invention, including rubber, rubberized nylon, rubberized rayon, rubberized fabric, PVC-fused materials such as rayon or fabric, and the like.

FIGS. 2A–2B depict first and second mattresses 12, 14 in further detail. As shown, hinge 16 includes seam portion 18 extending between adjacent edges of mattresses 12, 14. Seam 18 may comprise a single piece or multiple fused pieces of PVC or other material, and permits a wide-range of rotation of first and second mattresses 12, 14 relative to one another. As depicted in FIG. 2A, five connectors 28 are used to connect third mattress 22 to first mattress 12 for seating apparatus 10 depicted in FIG. 1. It will be appreciated by those skilled in the art, that the location, spacing and number of connectors 28 may vary to provide the connection between mattresses 12, 22, depending in part upon apparatus 10 size, the number of armrests 24, the type of connector 28, and the like.

FIG. 2B depicts a partial side view and partial cross-sectional side view of first and second mattresses 12, 14. It further depicts a plurality of support strips 34 contained within first mattress 12. Similarly, support strips 34 may be used within second mattress 14 and third mattress 22. Support strips 34 provide support for seating apparatus 10 to help stabilize system 10 during use. Support strips 34, depicted in FIG. 2 as generally cylindrical or loop-shaped support strips, are attached to the inner surfaces of mattress 12 as further described in conjunction with FIG. 4. The method of attaching support strips 34 depends in part upon the mattress and strip material. For example, for PVC mattresses 12, 14 having PVC support strips 34, heat welding, RF welding, gluing and the like may be used. As depicted in FIGS. 1 and 2, attaching support strips 34 may leave a plurality of imprints 90 on the surfaces of mattress 12, 14, 22.

FIGS. 3A and 3B depict a front plan view and a side plan view of seating apparatus 10, respectively. As shown, first and second mattresses have a length 40 and a width 42. First mattress 12 has a height 44 and second mattress 12 has a height 46. It will be appreciated by those skilled in the art that the dimensions selected for first and second mattresses 12, 14 may vary within the scope of the present invention, depending in part upon the size of the desired seating apparatus 10.

In one particular embodiment, seating apparatus 10 is a love seat. In such configuration, length 40 is about 60 inches, width 42 is about 37 inches and height 44, 46 are about 8 inches each. The indicated dimensions are for deflated mattresses 12, 14, and increase somewhat upon inflation. It will be appreciated by those skilled in the art that mattresses 12 and 14 may have identical dimensions with respect to height, width and length. In other embodiments, mattress 12 may have different dimensions than mattress 14.

Third mattress 22 has a length 50, a height 52, a top width 56 and a bottom width 54. For the embodiment in which seating apparatus 10 is a love seat, third mattress 22 is provided having length 50 of about 60 inches, height 52 of about 15 inches, top width 56 of about 12 inches and bottom width 54 of about 15 inches. Both armrests 24 have a width 60 and a height 58 of about 8 inches. It will be appreciated by those skilled in the art that dimensions of third mattress 22, including armrests 24, may vary widely within the scope of the present invention, depending in part upon the size of the desired seating apparatus 10.

In another embodiment, seating apparatus 10 comprises an armchair. In such a configuration, lengths 40 and 50 are about 39 inches, width 42 is about 37 inches and height 44 and 46 are about 8 inches, with the remaining dimensions previously described for the love seat remaining the same. The above recited dimensions are in the deflated state, and will increase upon inflation. It will be appreciated by those skilled in the art that the above noted dimensions are but two examples of a wide range of seating apparatus 10 and are not intended to limit the scope of the present invention.

In one particular configuration (not shown), it may be preferably to have height 44 and/or 46 be greater near a front edge 48 of seating apparatus 10 than height 44 and/or 46 near a back edge 49 of seating apparatus 10. In this manner, having a higher front edge 48 assists users in sitting back into seating apparatus 10.

While depicted with two arm rests 24, it will be appreciated by those skilled in the art that third mattress 22 may have a different number of arm rests 24, or none at all. FIGS. 3A–B depicts arm rest 24 connected to the front side of third mattress 22. Alternatively, arm rests 24 may be connected to the side of third mattress 22. Third mattress 22 with armrests 24 is depicted as comprising a single fluid chamber. Each armrest 24 and the remaining back portion of third mattress 22 also may comprise separate fluid chambers.

Figure 4A:
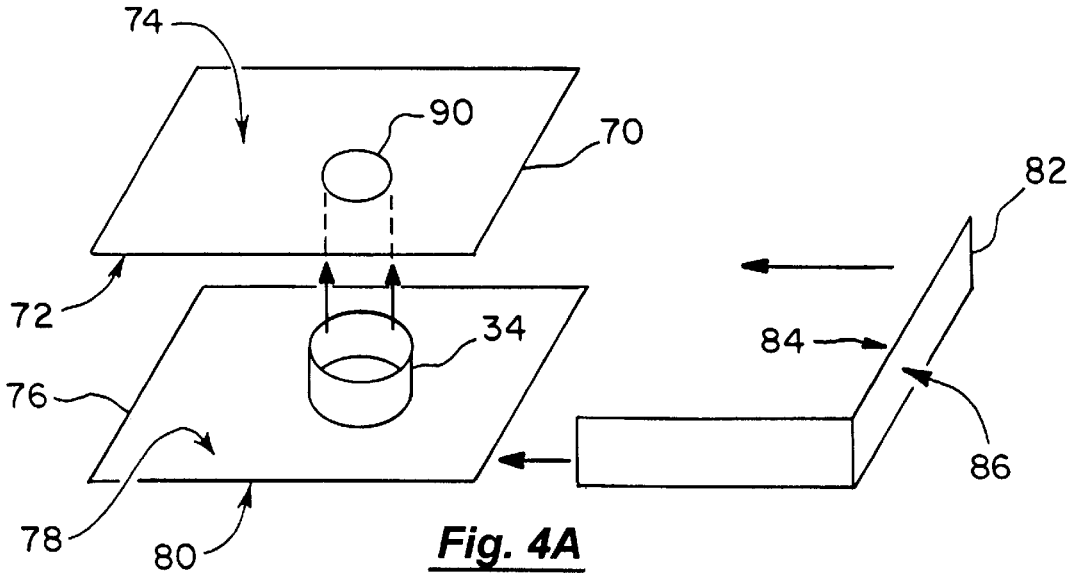
FIG. 4A depicts an exploded view of an inflatable mattress showing a cylindrical support strip therein.

Turning now to FIGS. 4A–4E, support strips 34 used with the present invention will be described in further detail. FIG. 4A depicts a top surface 70 of either first, second or third mattress 12, 14, 22. Top surface 70 has an inner face 72 and an outer face 74. FIG. 4A further depicts a bottom surface 76 of the mattress having an inner face 78 and an outer face 80. Support strip 34, shown as a cylindrical or loop-shaped support strip 34, is attached to inner face 78 and inner face 72. In this manner, support strip 34 provides support to the mattress comprising top surface 70 and bottom surface 76, particularly when the mattress is inflated. The attachment of support strip 34, produces an imprint 90 on top surface 70 and bottom surface 76. A gusset 82 is attached to top surface 70 and bottom surface 76 to form a periphery of the mattress. For embodiments where top surface 70, bottom surface 76 and gusset 82 comprise PVC, attaching the support strips 34 and gusset 82 can occur by heat welding, RF welding, gluing and the like.

Figure 4B:
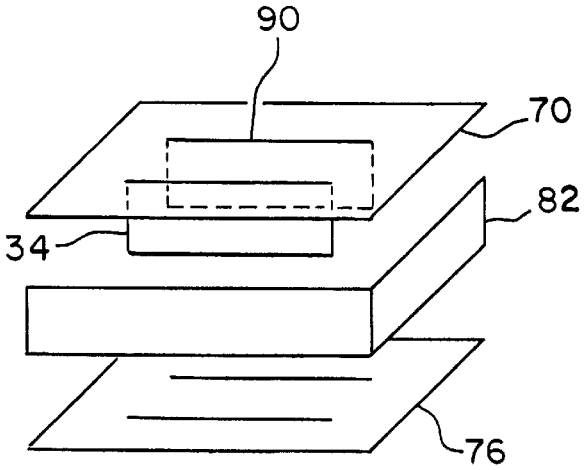
FIGS. 4B–4E depict alternative embodiments of support strips for mattresses of the present invention.
Figure 4C:
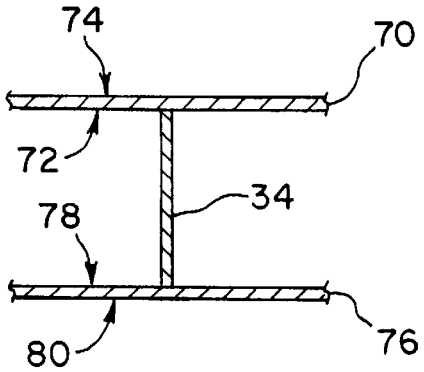

As shown in FIGS. 4B and 4C, support strips 88 need not be circular or cylindrical in shape, but can have a planar or other shape. Support strips 34 also can be rectangular, column-shaped and the like within the scope of the present invention. In this manner, inner face 72 of top surface 70 and inner face 78 of bottom surface 76 are attached to planar support strips 34. Gusset 82 again forms the periphery of the mattress. In this embodiment, attached support strips 34 produce generally linear imprints 90.

Figure 4D:
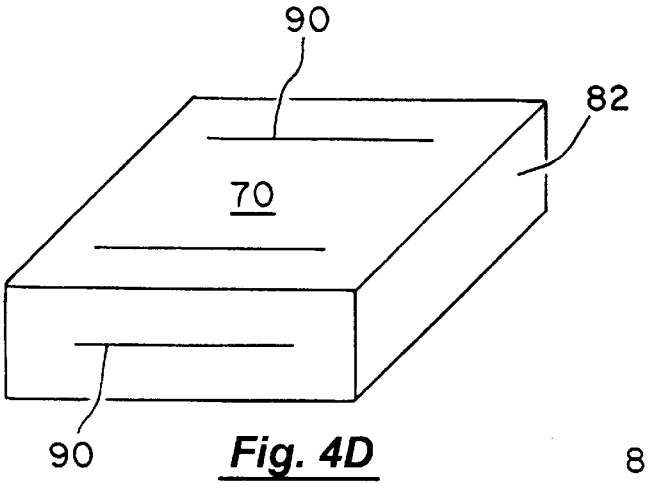
Figure 4E:
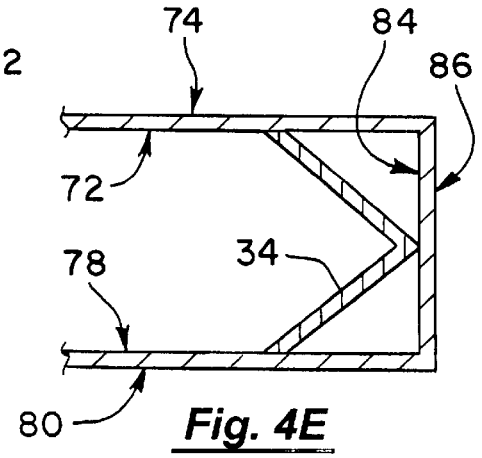

As shown in FIGS. 4D–4E, still another support strip configuration will be described. Support strip 34 can be a generally V-shaped support strip 34 connecting inner face 72 of top surface 70 with a gusset inner face 84. Similarly, support strip 34 connects gusset inner face 84 with inner face 78 of lower surface 76. In this manner, top surface 70, bottom surface 76 and gusset 82 may have imprints 90.

FIGS. 5A–E depict an exemplary connector 100 for connecting third mattress 22 to first mattress 12 as depicted in FIG. 1. Connector 100 comprises a recessed T-bar connector contained within each of two mattresses to be adjoined and connected together. Connector 100 includes a male portion 104 contained within a cup 102. Male portion 104 has a lower lip 106 and a larger upper lip 108. Cup 102 is affixed to an outer face 74 of top surface 70 of one mattress. Cup 102 extends into the interior of the mattress to provide a recessed area for male portion 104 as shown in FIG. 5C. In one embodiment, cup 102 and male portion 104 comprise PVC.

Connector 100 includes a female portion 110. Female portion 110 has two wings 114 and two caged portions 116 as shown in FIGS. 5B, 5D and 5E. Each caged portion 116 has an upper opening 118 and two or more side openings 120. Female portion 110 further includes a tether 112. In one embodiment, female portion comprises PVC.

The operation of connector 100 will now be described. Two mattresses, each having recessed male portions 104 contained within cups 102, are positioned so that male portions 104 are opposing one another. Female portion 110 is inserted between the opposing male portions 104 so that upper lip 108 of each male portion 104 fits within upper opening 118 of one caged portion 116. By rotating female portion 110 approximately 90 degrees, upper lips 108 engage side openings 120 of female portion 110. As shown in FIG. 5B, caged portion 116 has a generally rectangular shape so that upper lip 108 fits within upper opening 118 but, upon rotation of female portion 110, upper lip 108 extends at least part way under or through side openings 120. In this manner, female portion 110 engages upper lip 108 on both male portions 104 thereby providing a stable connection between male and female portions 104, 110. Wings 114 extend outward to provide further stability as shown in FIG. 5E. Tether 112 preferably is slipped over lower lip 106 so that female portion 110 can remain with one of the mattresses when disconnected.

It will be appreciated by those skilled in the art that other shaped cages 116 and upper lips 108 may be used within the scope of the present invention. Other connectors also may be used within the scope of the present invention, including non-recessed T-bar connectors, snaps, hook and look fasteners, clips and the like.

Figure 6A:
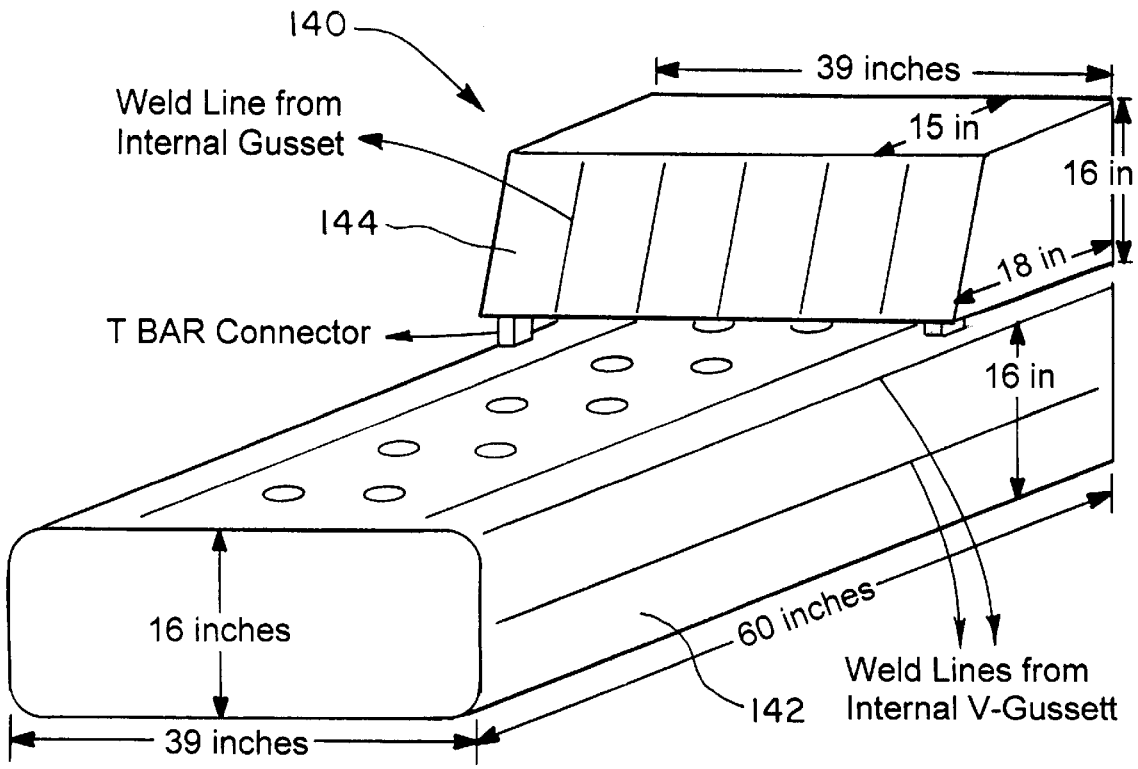
FIGS. 6A–6B depict an alternative embodiment of an inflatable seating apparatus of the present invention.
Figure 6B:
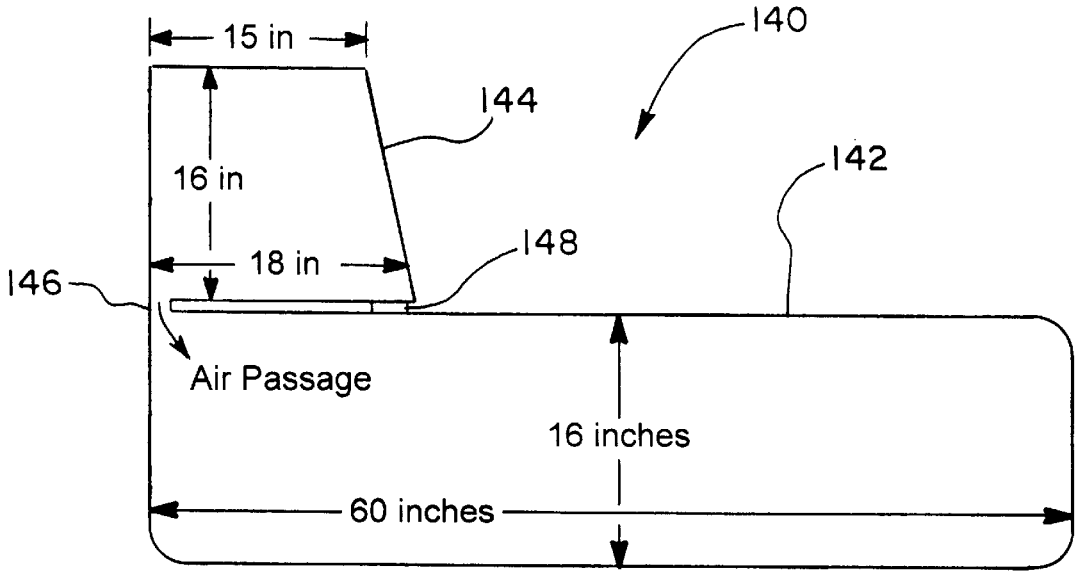

Turning now to FIGS. 6A–6B, an alternative seating apparatus 140 will be described. Seating apparatus 140 includes a first mattress 142 and a second mattress 144. Seating apparatus 140 comprises a chaise lounge having, for example, dimensions as depicted in FIGS. 6A–6B. It will be appreciated by those skilled in the art, that other dimensions may be used within the scope of the present invention. Second mattress 144 is hingedly connected to first mattress 142 by a hinge 146. Hinge 146 includes an air passageway as previously described. Further, seating apparatus 140 preferably includes at least one connector 148, as previously described, to further connect or stabilize second mattress 144 and first mattress 142. Operation of chaise lounge seating apparatus 140 depicted in FIG. 6 can include, for example, disconnecting connector 148 and rotating second mattress 144 with respect to first mattress 142 to form a flat bed-like type structure. In such a configuration seating apparatus 140 can be used for sun-bathing, sleeping, as a flotation device, or the like.

In an alternative embodiment not depicted, second mattress 144 is connected to first mattress 142 with a plurality of connectors 148 and does not have hinge 146. In this manner, first mattress 142 and second mattress 144 comprise separate air chambers and can be separated by disconnecting plurality of connectors 148.

Figure 7:
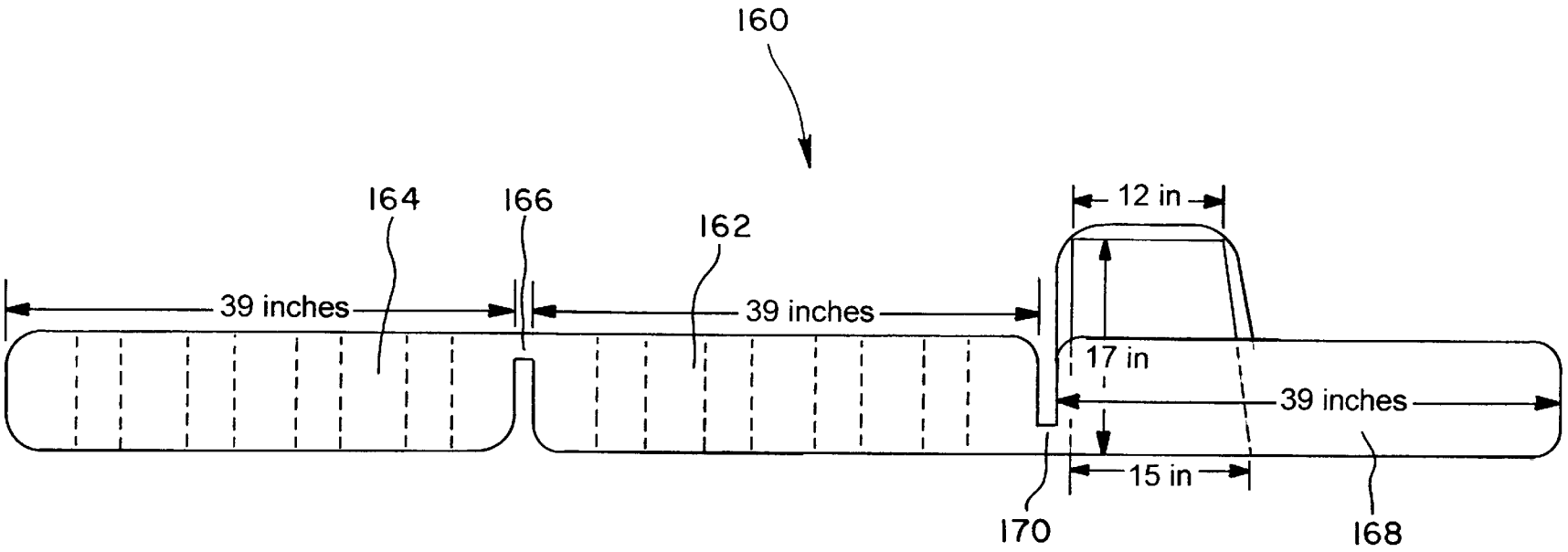
FIG. 7 depicts an alternative embodiment of an inflatable seating apparatus of the present invention positioned in a bed-like configuration.

FIG. 7 depicts still another embodiment of the present invention. FIG. 7 depicts a seating apparatus 160 having a first inflatable mattress 162 and a second inflatable mattress 164 hingedly connected by a hinge 166. First and second mattresses 162, 164 are essentially as previously described in conjunction with earlier Figures. Seating apparatus 160, however, further includes a second hinge 170 hingedly connecting a third mattress 168 to first mattress 162. In this manner, mattresses 162, 164 and 168 comprise a single air chamber, thereby facilitating ease of inflation of the entire seating apparatus 160. Hinges 166, 170 further permit rotation of mattresses 162, 164, 168 relative to one another to provide a bed-type structure with mattresses 162, 164, 168 in a side-by-side configuration. Hinges 166, 170 also permit rotation to place mattresses 162, 164 and 168 in a stacked arrangement.

Turning now to FIG. 8, still another embodiment of the present invention will be described. FIG. 8 depicts a seating apparatus 180 having a first inflatable mattress 182, a second inflatable mattress 184 and a third inflatable mattress 186. First and second mattresses 182, 184 are connected by a first plurality of connectors 188. Third mattress 186 is connected to first mattress 182 by a second plurality of connectors 190. Connectors 188, 190 may comprise, for example, the connectors described in conjunction with FIG. 5. In this configuration, each of the three mattresses comprises a separate air chamber and hence each mattress has a fluid port 92.

FIG. 9 depicts an inflatable seating system 200 having a slip cover 210 at least partially covering a seating apparatus, such as seating apparatus 180 shown in FIG. 8. System 200 further includes an inflation device 220, such as an electric air inflation device. Inflation device 220 is coupled to the fluid ports 192 of the seating apparatus and is used for inflation of inflatable mattresses therein. The use of slip cover 210 over the seating apparatus permits the use of a wide range of color patterns for seating apparatus.

In conjunction with earlier Figures, a method for using an inflatable seating apparatus of the present invention will be described. First, an inflatable seating apparatus, such as that previously described, is provided in a deflated state. The seating apparatus includes a first inflatable mattress, a second inflatable mattress, and a hinge rotatably connecting the first and second mattresses. The hinge has at least one passageway to permit the passage of an inflation fluid, such as air, between the first and second mattresses. The method includes the inflation of the first and second mattresses in a single step. This is possible due to the hinge passageway connecting the first and second mattresses. The method includes rotating the hinge to position the first and second mattress in a stacked arrangement and sitting on the stacked first and second mattresses.

The method further may include providing a third inflatable mattress whereby the third mattress forms a back of the seating apparatus. This method includes attaching the third mattress to the first mattress with a plurality of recessed connectors, and inflating the third mattress.

The invention has now been described in detail. However, it will be appreciated that certain changes and modifications may be made. For example, the positioning and number of armrests may vary within the scope of the present invention. Further, features described in conjunction with one embodiment or one figure may be used for additional embodiments as described herein. For example, while FIG. 1 depicts cylindrical imprints 90 due to cylindrical support strips 88, imprints 90 may be linear or have other shapes due to the use of different support strips 88.

Therefore, the scope and content of this invention are not limited by the foregoing description. Rather, the scope and content are to be defined by the following claims.

What is claimed is:

1. An inflatable seating apparatus comprising:

a first inflatable mattress;

a second inflatable mattress rotatably connected to said first mattress by a hinge, said hinge having an air-tight seam portion and at least one passageway to permit the passage of an inflating fluid between said first and said second mattresses, said hinge adapted to permit rotation of said first mattress about said hinge to overlay said second mattress; and a third inflatable mattress forming a back of the sealing apparatus, said third mattress removably attached to said first mattress with a plurality of connectors.

2. An inflatable seating apparatus as in claim 1, wherein said connectors comprise a plurality of male-female connectors.

3. An inflatable seating apparatus as in claim ta said third mattress further comprising at least one arm rest inflatably coupled thereto, said at least one arm rest removably attached to said first mattress with said plurality of connectors.

4. An inflatable seating apparatus as in claim 1, wherein said hinge is rotatable through at least about 180 degrees of rotation so that said first and said second mattresses are positioned in a stacked arrangement.

5. An inflatable seating apparatus as in claim 1, wherein said hinge is rotatable so that said first and said second mattresses are positioned in a side-by-side arrangement so that said first and said second mattresses each define a portion of a seating surface.

6. An inflatable seating apparatus as in claim 1, further comprising a plurality of spaced apart support strips contained within said first and said second mattresses said support strips coupled to opposing inner surfaces of said first mattress, and coupled to opposing inner surfaces of said second mattress.

7. An inflatable seating apparatus as in claim 1, wherein said first mattress, said second mattress and said passageway together comprise a single fluid chamber.

8. An inflatable seating apparatus as in claim 1, wherein said seam portion connects an edge of said first mattress with an edge of said second mattress.

9. An inflatable seating apparatus as in claim 1, wherein said first and said second mattresses comprise polyvinylchloride (PVC).

10. An inflatable seating apparatus as in claim 1, wherein said hinge comprises polyvinylchloride (PVC).

11. An inflatable seating apparatus as in claim 1, wherein said inflating fluid comprises air.

12. An inflatable seating apparatus as in claim 1, wherein said hinge is integrally formed with said first and said second mattresses.

13. An inflatable seating apparatus as in claim 1, wherein said first mattress further comprises:

a top surface having an inner face and an outer face;

a bottom surface spaced apart from said top surface, said bottom surface having an inner face and an outer face;

a gusset having an inner face and an outer face, said gusset defining a periphery of said mattress between said top surface and said bottom surface; and a plurality of support strips connected between said inner face of said top surface and said inner face of said bottom surface.

14. An inflatable seating apparatus as in claim 13, wherein said support strips comprise polyvinylchloride (PVC).

15. An inflatable seating apparatus as in claim 1, wherein said first mattress has a length, a width and a height that are about equal to a length, a width and a height of said second mattress, respectively.

16. An inflatable seating apparatus, comprising:

a first inflatable mattress having a top surface;

a bottom surface spaced apart from said top surface;

a gusset defining a periphery of said first mattress between said top surface and said bottom surface;

said top surface, said bottom surface and said gusset each having an inner face and an outer face; and a plurality of support strips connected between said inner face of said top surface and said inner face of said gusset;

a second inflatable mattress rotatable connected to said first mattress by a hinge, said hinge having at least one passageway to permit the passage of an inflating fluid between said first and said second mattresses, said hinge adapted to permit rotation of said first mattress about said hinge to overlay said second mattress; and a third inflatable mattress forming a back of the seating apparatus, said third mattress removably attached to said first mattress with a plurality of connectors.

17. An inflatable seating apparatus comprising:

a first inflatable mattress;

a second inflatable mattress;

a hinge rotatably connecting said first and said second mattresses, said hinge having an air-tight seam portion and at least one passageway to permit the passage of an inflating fluid between said first and said second mattresses, said hinge having a range of rotation to permit said first and said second mattresses to be positioned in a stacked configuration; and a third mattress forming a seating apparatus back, said third mattress removably attached to said first mattress with a plurality of connectors.

18. An inflatable seating apparatus as in claim 17, wherein said connectors comprise polyvinylchloride (PVC).

19. An inflatable seating apparatus comprising:

a first inflatable mattress;

a second inflatable mattress;

a hinge rotatably connecting said first and said second mattresses, said hinge having a seam portion and at least one passageway to permit the passage of an inflating fluid between said first and said second mattresses, said hinge having a range of rotation to permit said first and said second mattresses to be positioned in a stacked configuration; and a third mattress forming a seating apparatus back, said third mattress removably attached to said first mattress with a plurality of connectors, wherein each of said connectors comprise a first male portion recessed within an upper surface of said first mattress;

a second male portion recessed within a lower surface of said third mattress; and a female portion adapted to receive said first and said second male portions to removably attach said first mattress to said third mattress.

20. An inflatable seating apparatus comprising:

a first inflatable mattress;

a second inflatable mattress;

a hinge rotatable connecting said first and said second mattresses, said hinge having an air-tight seam portion and at least one passageway to permit the passage of an inflating fluid between said first and said second mattresses, said hinge having a range of rotation to permit said first and said second mattresses to be positioned in a stacked configuration; and at least one connector connecting a lower surface of said first mattress with an upper surface of said second mattress.

21. An inflatable seating apparatus comprising:

a first inflatable mattress;

a second inflatable mattress having first and second edges, said first edge rotatably connected to said first mattress by a hinge, said hinge having an air-tight seam portion and at least one passageway to permit the passage of an inflating fluid between said first and said second mattresses, said second edge coupled to said first mattress with a plurality of spaced apart connectors, said second mattress forming a back of the seating apparatus; and wherein said first and second mattresses are coupled together in a stacked configuration providing a seating area on said first inflatable mattress.

22. An inflatable seating apparatus comprising:

a first inflatable mattress;

a second inflatable mattress substantially underlying and removably attached to said first mattress with a first plurality of spaced apart connectors so that said first and second mattresses define a seating portion of said apparatus; and a third inflatable mattress forming a seating apparatus back and removably attached to said first mattress with a second plurality of spaced apart connectors;

wherein each of said first plurality of connectors comprise a first male portion recessed within an upper surface of said second mattress;

a second mate portion recessed within a lower surface of said first mattress; and a female portion adapted to receive said first and said second male portions to removably attach said first mattress to said second mattress.

23. A seating system comprising:

a seating apparatus, said seating apparatus comprising a first inflatable mattress;

a second inflatable mattress rotatably connected to said first mattress by a hinge, said hinge having an air-tight seam portion and at least one passageway to permit the passage of an inflating fluid between said first and said second mattresses, said hinge adapted to permit rotation of said first mattress about said hinge to at least partially overlay said second mattress; and a third inflatable mattress removably attached to said first mattress with a plurality of connectors to define a back of said seating apparatus;

an inflation device; and a removable slip cover to at least partially cover said seating apparatus.

24. A method of using an inflatable seating apparatus, comprising the steps of:

providing an inflatable seating apparatus in a deflated state, said seating apparatus comprising:

a first inflatable mattress;

a second inflatable mattress; and a hinge rotatable connecting said first and said second mattresses, said hinge having an air-tight seam portion and at least one passageway to permit the passage of an inflating fluid between said first and said second mattresses;

inflating said first mattress and said second mattress in a single step;

rotating said hinge to position said first mattress in a stacked arrangement with said second mattress;

providing a third inflatable mattress, said third mattress forming a back of said seating apparatus;

attaching said third mattress to said first mattress using a plurality of connectors; and inflating said third mattress.

* * * * *